US005507574A

United States Patent [19]

Dickey

[11] Patent Number: 5,507,574

[45] Date of Patent: Apr. 16, 1996

[54] VARIABLE SPEED MIXER

[76] Inventor: Douglas Dickey, 2523 S. Park Ave., North Riverside, Ill. 60546

[21] Appl. No.: 372,920

[22] Filed: Jan. 13, 1995

[51] Int. Cl.[6] ..... B01F 9/12

[52] U.S. Cl. ..... 366/213; 366/14; 366/224; 366/225; 366/231; 366/232; 366/235; 366/605

[58] Field of Search ..... 366/208, 209, 366/211, 213, 214, 216, 217, 220, 222, 224, 225, 230, 231, 232, 235, 14, 60, 61, 62, 63, 605

[56] References Cited

U.S. PATENT DOCUMENTS

| | | | |
|---|---|---|---|
| 3,430,927 | 3/1969 | Pouzar | 366/213 |
| 4,403,867 | 9/1983 | Duke | 366/213 |
| 4,720,194 | 1/1988 | Friedland | 366/222 |
| 4,842,415 | 6/1989 | Cane | 366/605 |
| 5,236,263 | 8/1993 | Friedland | 366/224 |

*Primary Examiner*—Robert W. Jenkins
*Attorney, Agent, or Firm*—Emrich & Dithmar

[57] ABSTRACT

Apparatus for mixing liquids such as ink and paint includes a support platform having a plurality of rotating spindle and support tray combinations. Each tray is adapted to receive and support a respective open container or bucket containing ink or paint to be mixed, while each spindle is coupled to and rotationally driven by a respective hydraulic motor. A blade positioned within each container thoroughly mixes the container's contents as the container rotates. Hydraulic motor control allows each container to be rotated at a selected fixed RPM or at a continuously variable RPM for improved control of mixing of the materials within the container. By controlling mixer RPM, increased quantities of the ingredients may be mixed within the tub without spilling the contents, while also permitting faster, more thorough mixing of the ingredients. Each support tray is adapted to receive either a large container such as on the order of 15 gallons or a 3.5 gallon kit adaptor to mix smaller portions. A moveable support frame and hoist arrangement facilitates handling and removal of the large containers from the apparatus. Another embodiment employs a single mixing element such as a rotating blade for all of the containers on the support platform, where the blade is attached to a moveable support arm which can be moved from one container to another without moving the container itself. The rotating mixing element may be used in combination with the rotationally displaced container to provide even greater mixing capacity under precisely controlled conditions.

16 Claims, 4 Drawing Sheets

VARIABLE SPEED MIXER

FIELD OF THE INVENTION

This invention relates generally to the mixing, blending and stirring of solutions and is particularly directed to apparatus for mixing a batch of ink or paint which affords precise control of the mixing rate which can be varied over a wide range of values in a continuous manner.

BACKGROUND OF THE INVENTION

Solutions such as inks and paints are produced by mixing various ingredients to produce the end product having the desired characteristics of color, consistency and texture. The mixing process is critical to the end result with the mixing rate and duration being two critical parameters in this process. It is, of course, desireable to use the optimum mixing rate or speed as well as the minimum mixing time to produce the desired results. The optimum mixing rate for a given solution depends upon the characteristics of the individual ingredients. Thus, a given mixing rate for a first set of ingredients may not result in optimum mixing of a second set of ingredients, or may require additional mixing time to produce the desired result. Present approaches employ fixed speed mixers for these types of materials thus necessitating different mixers for different materials or in some cases extended periods of mixing when the mixer speed is not adapted for mixing a particular set of ingredients.

In mixing materials such as inks and paints, it is generally desirable to mix as much of the material as possible by filling the mixing container to, or near, its capacity. This frequently results in overflow or spilling of the contents such as in the case of a high mixing speed applied to a thin solution having low consistency. In many cases, optimal mixing of a solution is achieved by starting with a low mixing speed and then increasing the speed as the mixture becomes more thoroughly mixed. This is not possible with current fixed speed mixers.

The present invention addresses the aforementioned limitations of the prior art by providing a variable speed mixer particularly adapted for use with inks and paints which permits the simultaneous mixing of several batches of ingredients at different, fixed mixing rates and which also allows for varying the mixing rate over a wide range of speeds in a continuous manner for each of the batches.

OBJECTS AND SUMMARY OF THE INVENTION

Accordingly, it is the object of the present invention to provide a variable speed mixer for improved blending and stirring of mixtures such as of ink or paint.

It is another object of the present invention to provide a continuously variable hydraulic drive arrangement for an ink or paint solution mixing apparatus which allows the rotation speed of the mixer container to be varied over a wide range of RPMs in a continuous manner.

Yet another object of the present invention is to provide a multi-batch mixing apparatus for blending and stirring solutions in several large tubs which facilitates handling of the filled tubs after mixing and their removal from the apparatus.

A further object of the present invention is to provide a multi-batch mixing arrangement for mixing the solutions in a plurality of discrete containers using a single variable speed mixing element moveable between the various containers for adjusting the mixing rate for each container.

These objects of the present invention are achieved and the disadvantages of the prior art are overcome by an apparatus for mixing ink or paint, the apparatus comprising: a support surface; a plurality of bucket holders disposed on the support surface, wherein each holder is adapted to receive and support a respective bucket containing a batch of ink or paint; a mixing blade disposed in the batch of ink or paint in each of the buckets; a hydraulic drive arrangement coupled to each of the holders for rotationally displacing each of the holders and a respective bucket disposed thereon at a selected RPM; and a controller coupled to the hydraulic drive arrangement and responsive to a user input for varying the RPM at which each bucket and holder combination is driven over a range of RPMs in a continuous manner.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
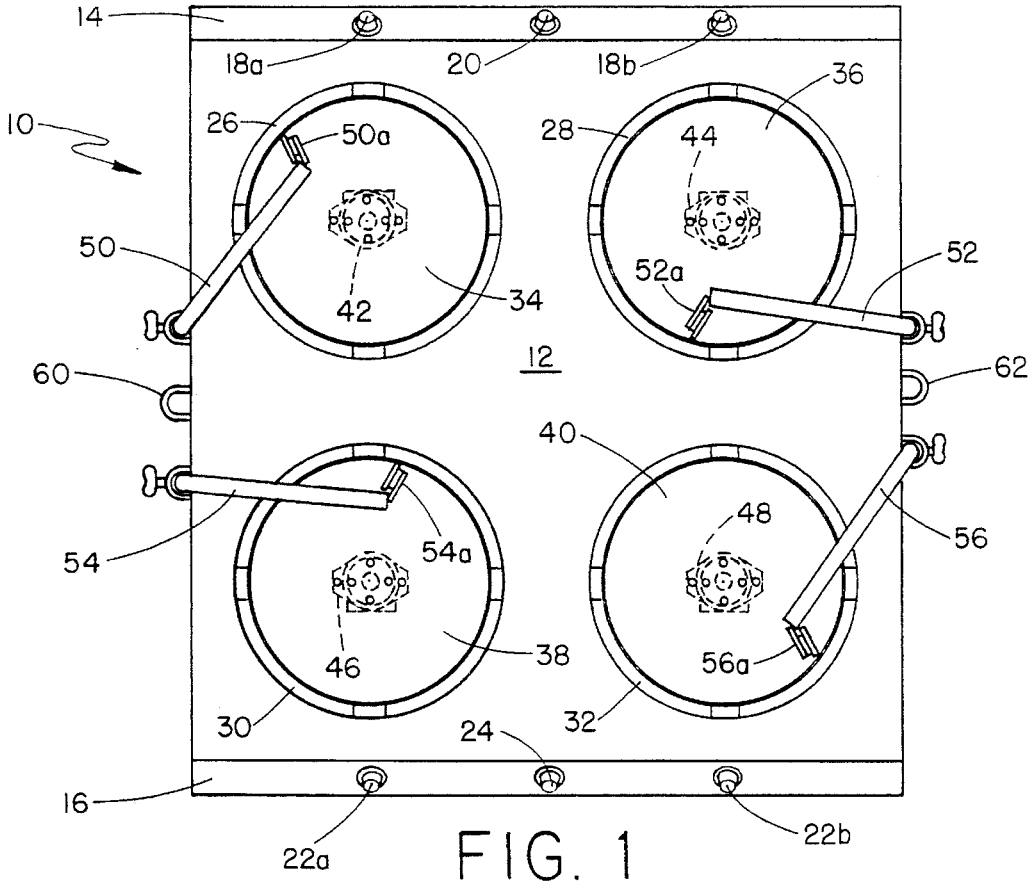
FIG. 1 is a top plan view of a multi-batch, variable speed mixer in accordance with the principals of the present invention.
Figure 2:
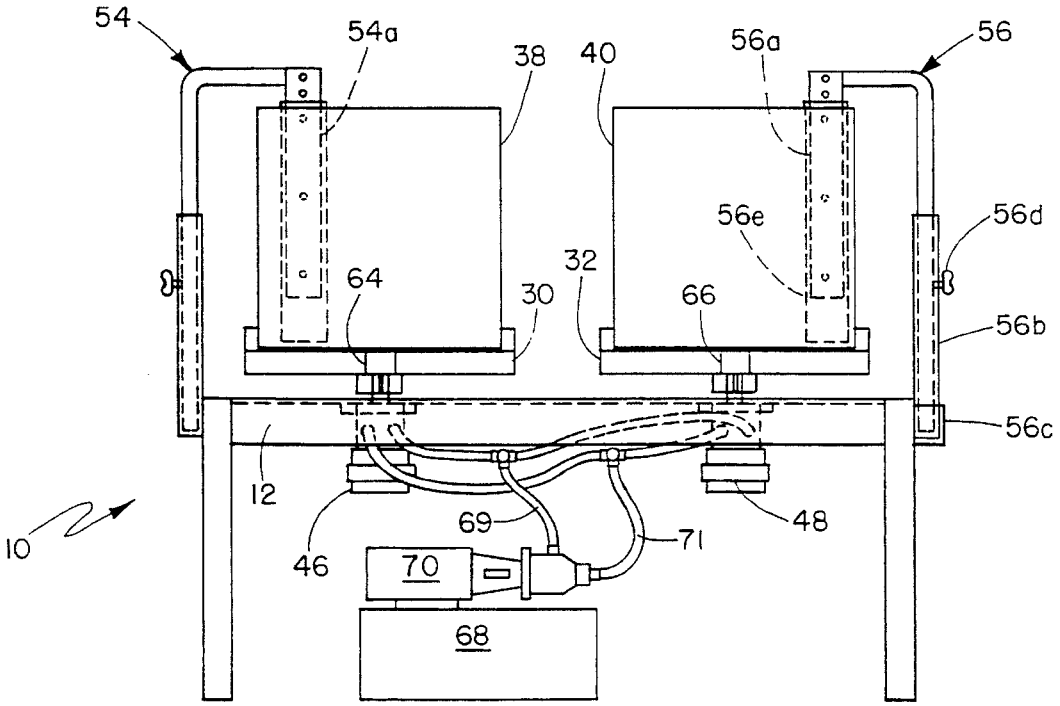
FIG. 2 is a side elevation view of the mixer apparatus of FIG. 1.

Referring to FIG. 1, there is shown a top plan view of a variable speed mixer 10 in accordance with the present invention. FIG. 2 is a side elevation view of the variable speed mixer 10 shown in FIG. 1.

The variable speed mixer 10 includes a generally flat support platform 12 on which are disposed first, second, third and fourth bucket, or container, holders 26, 28, 30 and 32. Each of the four bucket holders is generally flat and round, having an outer peripheral lip for receiving a respective bucket containing a solution to be mixed. Thus, the first, second, third and four bucket holders 26, 28, 30 and 32 are respectively adapted to receive first, second, third and fourth buckets 34, 36, 38 and 40. Disposed on facing lateral portions of the support platform 12 are first and second control panels 14 and 16. The first control panel 14 includes first and second speed control needle valves 18*a* and 18*b* as well as a first On/Off switch 20. Similarly, the second control panel 16 includes third and fourth speed control needle valves 22*a* and 22*b* as well as a second On/Off switch 24. The first and second speed control needle valves 18*a*, 18*b* respectively control the operation of the first and second bucket holders 26 and 28, while the third and fourth speed control needle valves 22*a*, 22*b* respectively control the operation of the third and fourth bucket holders 30 and 32 as described below.

Respectively disposed adjacent the first, second, third and fourth bucket holders 26, 28, 30 and 32 are first, second, third and fourth mixing blade assemblies 50, 52, 54 and 56. Each of the four mixing blade assemblies 50, 52, 54 and 56 includes a respective upright support and a downwardly extending blade 50*a*, 52*a*, 54*a* and 56*a*. Each of the mixing blades is disposed within a respective bucket for mixing the contents thereof as the bucket is rotated on its associated rotating holder. This is shown in FIG. 2 for mixing blades 54*a* and 56*a* respectively within buckets 38 and 40. Additional details of each of the mixing blade assemblies are shown in FIG. 2 for the case of the fourth mixing blade assembly 56. The generally upright support of the mixing blade assembly 56 includes a support tube 56*b* attached to the support platform 12 by means of a mounting bracket 56*c*. The height of the mixing blade 56*a* as well as its position from the bucket's sidewall can be adjusted by means of a wingnut 56*d*. Attached to the mixing blade 56*a* is an outer polyurethane sheath 56*e*.

Attached to a lower surface of support platform 12 are first, second, third and fourth hydraulic motors 42, 44, 46 and 48. The first, second, third and fourth hydraulic motors 42, 44, 46 and 48 are respectively coupled to the first, second, third and fourth bucket holders 26, 28, 30 and 32 for rotationally displacing the bucket holder and a bucket disposed therein. Each of the hydraulic motors is coupled to and rotationally driven by means of the combination of an electric motor 70 and a hydraulic pump and reservoir 68 as shown for the case of hydraulic motors 46 and 48 in FIG. 2. Each of the hydraulic motors is coupled to the combination of electric motor 70 and hydraulic pump and reservoir 68 by means of a pressure line 69 and a return line 71 as shown in FIG. 2. Additional details of the manner in which the four hydraulic motors are driven by the combination of electric motor 70 and hydraulic pump and reservoir 68 are provided below.

Figure 3:
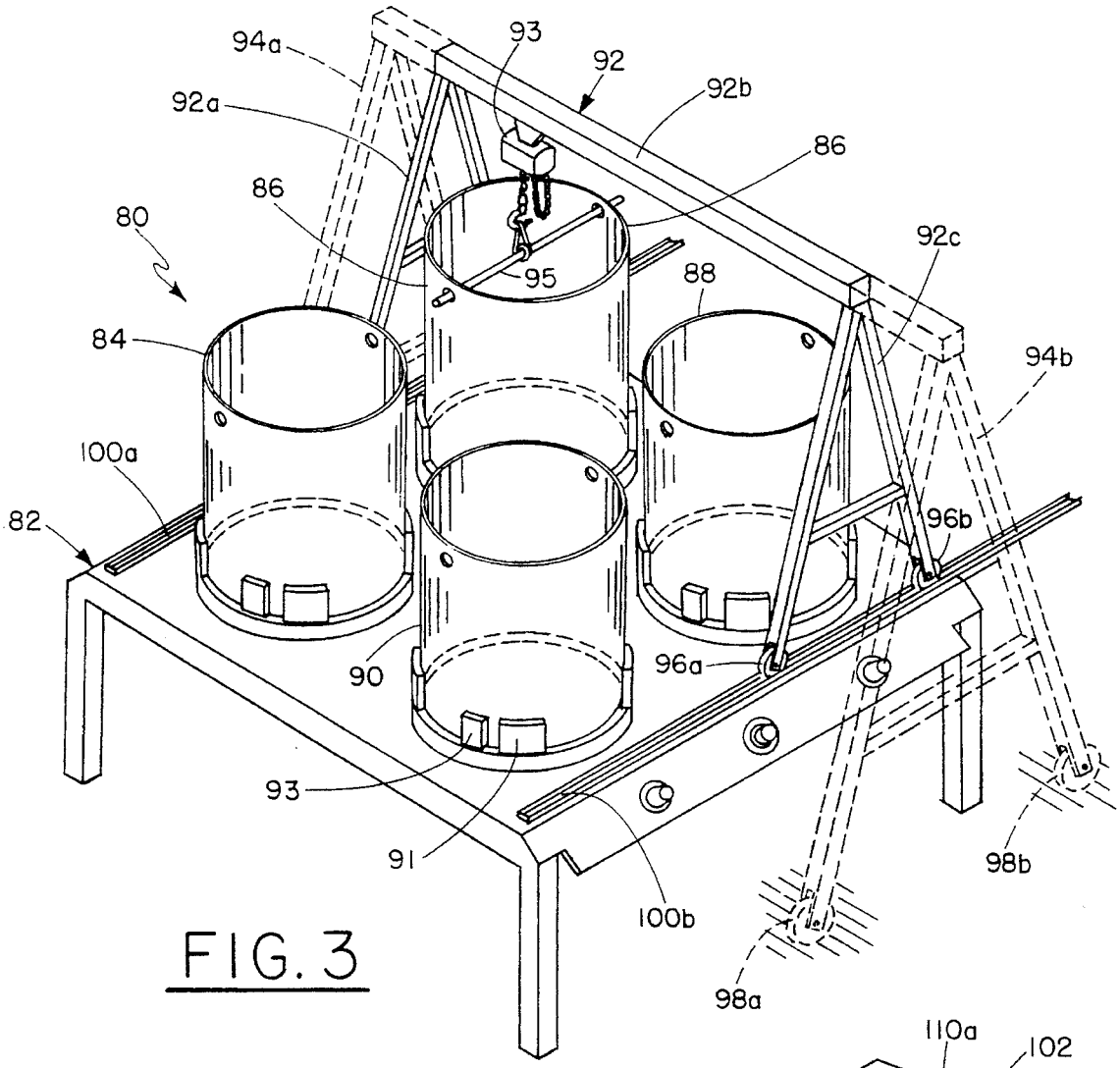
FIG. 3 is a perspective view of another embodiment of the mixer of FIG. 1 including apparatus for lifting and removing the batch containers after mixing.

Referring to FIG. 3, there is shown a perspective view of another embodiment of a variable speed mixer 80 in accordance with the present invention. As in the previously described embodiment, variable speed mixer 80 includes a support platform 82 having four bucket holders upon which are mounted first, second, third and fourth buckets 84, 86, 88 and 90. Also disposed on support platform 82 is a hoist mechanism 92. Hoist mechanism 92 includes first and second end A-frames 92*a* and 92*c* as well as a crossmember 92*b* disposed between and coupled to the two A-frames. Suspended from the cross member 92*b* is a chain hoist 93 which is adapted to engage and lift the buckets by means of a lift bar 95 inserted through facing apertures as shown for the case of bucket 86 in the figure. Disposed on the support platform 82 are first and second tracks 100*a* and 100*b*. Disposed on the lower portions of each of the first and second A-frames 92*a* and 92*c* are a pair of rollers, or wheels, is shown for the case of the second A-frame having wheels 96*a* and 96*b*. The pairs of wheels are adapted for positioning on a respective track 100*a* and 100*b* for facilitating displacement of the hoist mechanism 92 and a bucket suspended therefrom from the support platform 82 for removing the bucket following mixing.

Another embodiment of the hoist mechanism 92 is shown in dotted line form in FIG. 3. The hoist mechanism 92 may include first and second end extensions 94*a* and 94*b* attached to respective ends of the cross member 92*b*. Each of the first and second end extensions 94*a*, 94*b* is also comprised of an A-frame and has a respective pair of rollers on a lower portion thereof as shown for the case of rollers 98*a* and 98*b* on the second end extension 94*b*. The rollers attached to the lower portions of the first and second end extensions 94*a*, 94*b* are positioned on the floor upon which the support platform rests for facilitating removal of the buckets from the support platform following mixing. Where the end extensions 94*a* and 94*b* are incorporated in the hoist mechanism 92, the previously described A-frames 92*a* and 92*c* are not needed. Also as shown in FIG. 3, each bucket holder may be provided with a lock member 91 and each bucket may be provided with an outer flange 93. During rotation of a bucket holder its lock member and the outer flange of its bucket may become engaged in abutting contact to prevent slippage of the bucket on the bucket holder.

Figure 4:
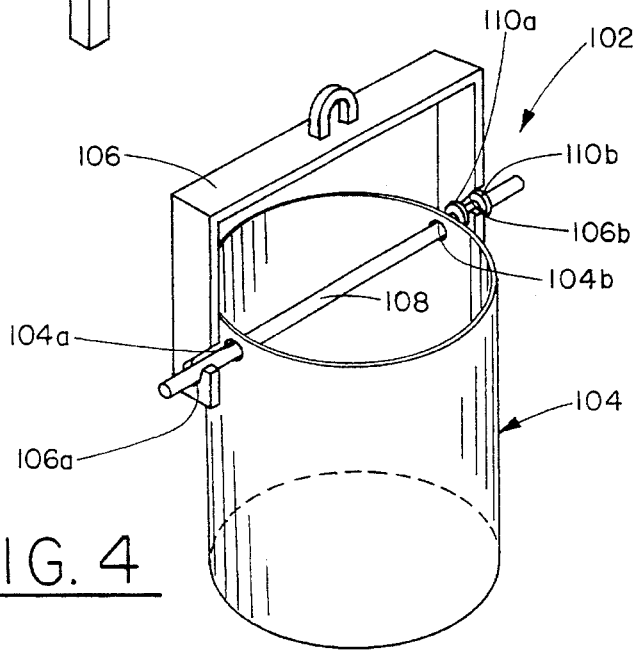
FIG. 4 is a perspective view illustrating a batch container and an apparatus for engaging and removing the container.

Referring to FIG. 4, there is shown a perspective view of a bucket engaging arrangement 102 for lifting and removing the buckets from the support platform. The bucket engaging arrangement 102 includes a lift bracket 106 coupled to and supported from a hoist mechanism which is not shown in the figure for simplicity. Lift bracket 106 includes a pair of hooks 106*a* and 106*b* on respective ends thereof for engaging a lift bar 108 inserted through opposed apertures 104*a* and 104*b* in a bucket 104. Disposed on one end of the lift bar 108 in a spaced manner, are first and second retaining rings 110*a* and 110*b* for preventing the lift bar 108 from sliding out of engagement with the lift bracket 106.

Figure 5:
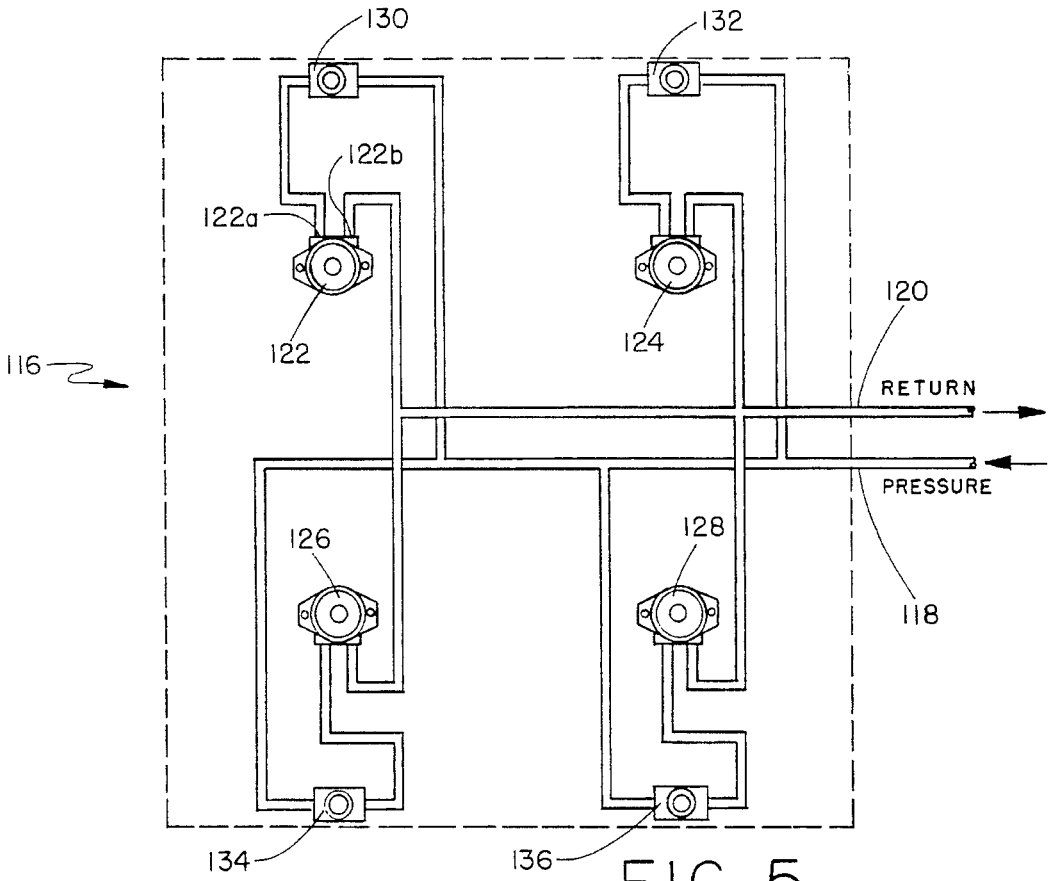
FIG. 5 is a simplified schematic diagram of a hydraulic speed control system for use in the variable speed mixer of the present invention.

Referring to FIG. 5, there is shown a simplified schematic diagram of a hydraulic speed control system 116 for use in the variable speed mixer of the present invention. The hydraulic speed control system 116 is coupled to the aforementioned combination of the electric motor and hydraulic reservoir by means of a pressure line 118 and a return line 120. The pressure and return lines 118, 120 form a close hydraulic system with four hydraulic motors 122, 124, 126 and 128 and four speed control valves 130, 132, 134 and 136. As shown in the figure, each hydraulic motor has associated therewith a respective speed control valve for controlling the rotational speed of the hydraulic motor and the associated bucket and bucket holder combination to which it is coupled. In a preferred embodiment, each of the four speed control valves is a needle valve for regulating the flow of hydraulic fluid to its associated hydraulic motor. As shown for the case of the first hydraulic motor 122, each hydraulic motor has an input port 122*a* to which its associated speed control valve 130 is connected as well as an output port 122*b* which is coupled to the return line 120. The first and second speed control valves 130 and 132 shown in FIG. 5 are respectively coupled to the first pair of speed control valves or needle valves 18*a* and 18*b* shown in FIG. 1. Similarly, the third and fourth speed control valves 134 and 136 are coupled to the second pair of needle valves 22*a* and 22*b* also shown in FIG. 1.

Figure 6:
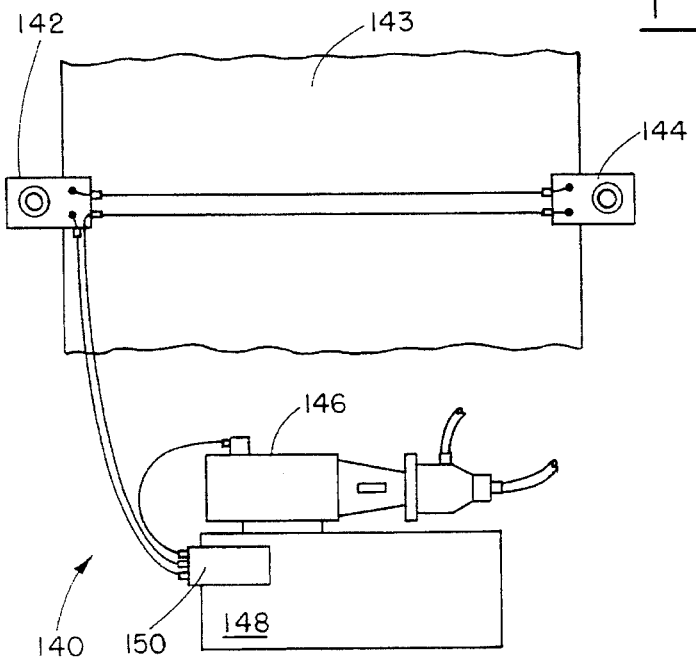
FIG. 6 is a simplified schematic diagram of an On/Off control system for use in the variable speed mixer of the present invention.

Referring to FIG. 6, there is shown a simplified schematic diagram of an On/Off control system 140 for use in the variable speed mixer. The On/Off control system 140 includes first and second stop/start switches 142 and 144 positioned in respective control panels on the support platform. The first and second stop/start switches 142, 144 are coupled to an electric motor 146 by means of a magnetic starter and transformer controller 150. The magnetic starter and transformer controller 150 energizes as well as turns-off the electric motor 146 and responds to selection of the first and second stop/start switches 142, 144. As previously described, the electric motor 146 is coupled to a hydraulic pump and reservoir 148. The first and second stop/start switches 142, 144 in FIG. 6 respectively correspond to first and second On/Off switches 20 and 24 described above and shown in FIG. 1.

Figure 7:
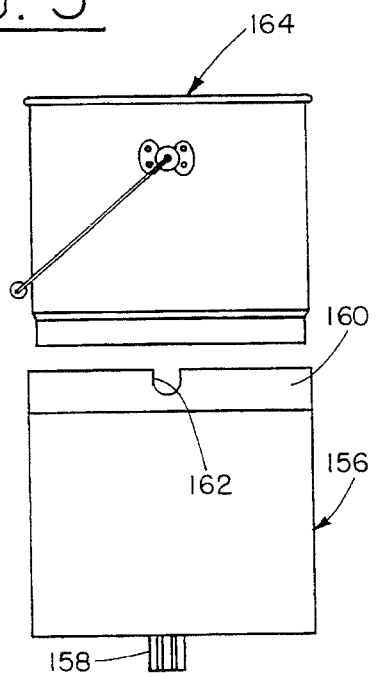
FIG. 7 is a side elevation view of a kit adapter for use in the present invention in mixing reduced portions of a solution.

Referring to FIG. 7, there is shown a bucket adapter 156 for use in another embodiment of the present invention. The bucket adapter 156 is adapted to receive a smaller container or bucket 164 typically on the order of 3½ gallons in size as opposed to the 15 gallon buckets described above. The bucket adapter 156 includes a splined coupling 158 on the lower surface thereof for engaging a hydraulic motor once positioned upon a bucket holder for rotational displacement of the bucket and bucket adapter. The bucket adapter 156 includes a metal reinforcing strip 160 disposed about the upper lip thereof as well as a pair of facing slots 162 for receiving the handle portion of bucket 164. The bucket adapter 156 is interchangeable with the buckets described above for the purpose of mixing smaller portions of solutions.

Figure 8:
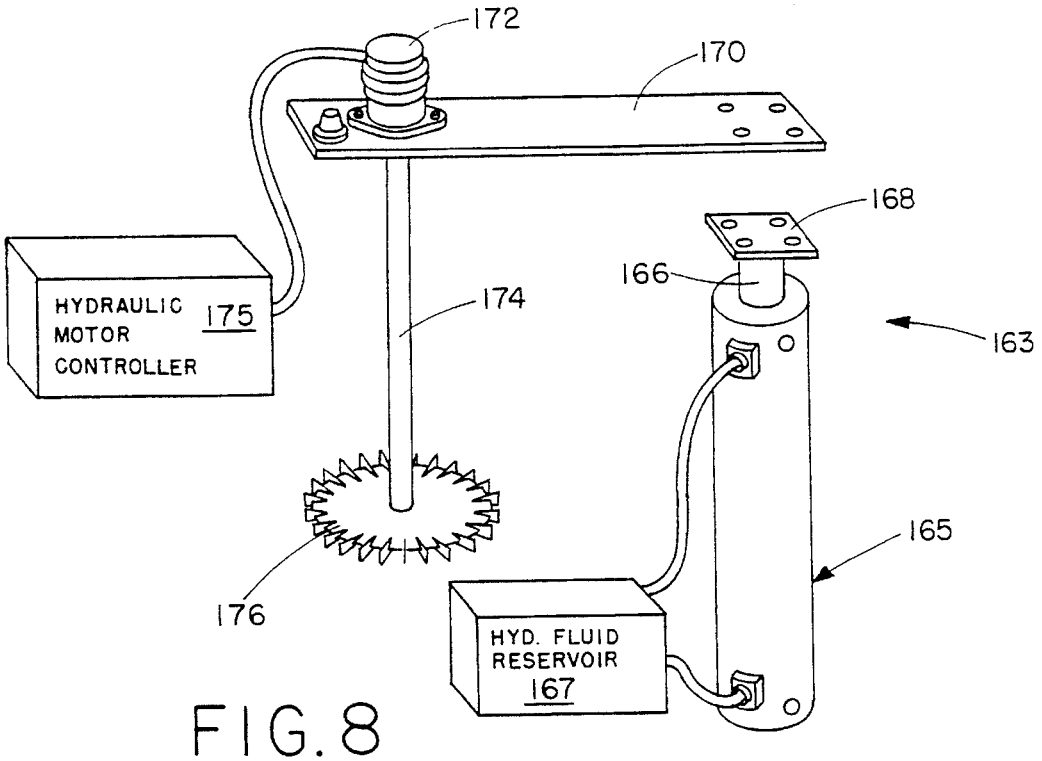
FIG. 8 is a partially exploded perspective view of a mixer element for use in another embodiment of a variable speed mixer in accordance with the present invention.
Figure 9:
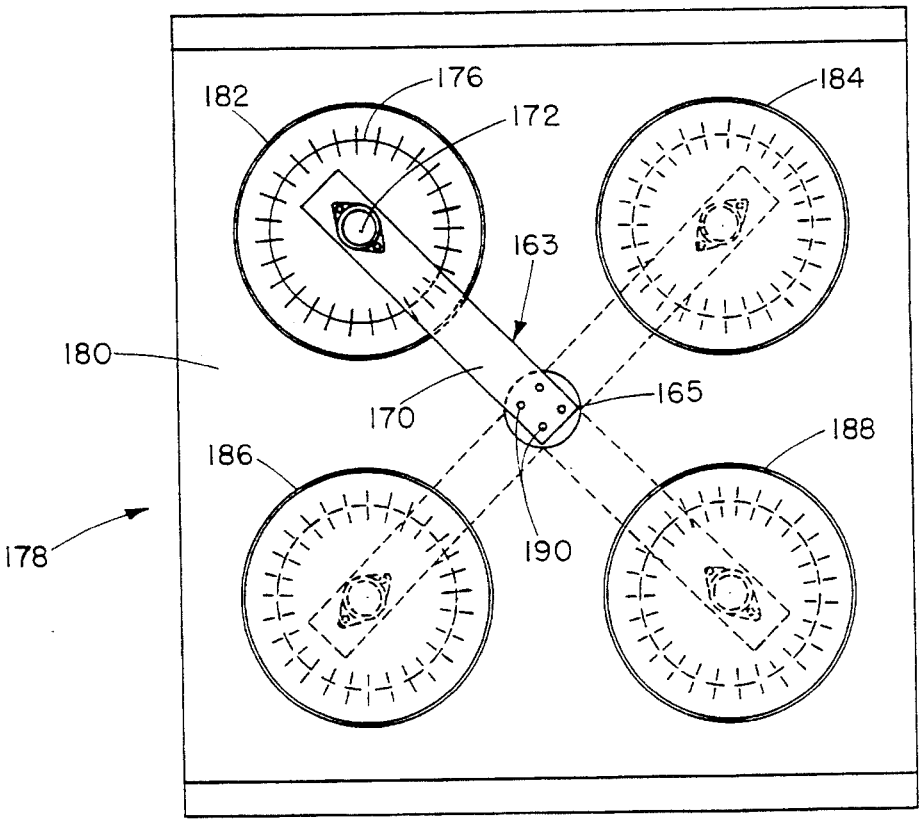
FIG. 9 is a top plan view of an embodiment of a variable speed mixer in accordance with one aspect of the present invention employing the mixer element shown in FIG. 8.

Referring to FIG. 8, there is shown a partially exploded, perspective view of a mixing element 163 for use in another embodiment of the present invention. The position of the mixing element 163 on the support platform 180 of a variable speed mixer 178 in accordance with another embodiment of the present invention is shown in the top plan view of FIG. 9. Mixing element 163 includes a hydraulic cylinder 165 having an extendable cylinder rod 166 to an end of which is attached a mounting bracket 168. Mixing element 163 further includes a support arm 170 attached to the mounting bracket 168 by means of a plurality of nut and bolt combinations 190 as shown in FIG. 9. The lower end of the hydraulic cylinder 165 is mounted to the support platform 180 by conventional means such as a mounting bracket which is not shown in the figures for simplicity. Rod 166 is freely rotatable within the hydraulic cylinder 165 and is extendable in a vertical direction in response to the application of hydraulic pressure to the cylinder by a hydraulic fluid pressure source 167.

Disposed on the distal end of support arm 170 is the combination of a hydraulic motor 172 and a shaft 174 coupled to and suspended from the hydraulic motor. Attached to the distal end of shaft 174 is a toothed, disc-shaped mixing blade 176. Hydraulic motor 172 is coupled to a hydraulic motor controller 175 for rotationally displacing the combination shaft 174 and mixing blade 176.

As shown in FIG. 9, mixing element 163 is positioned generally in the center of support platform 180 and is disposed intermediate first, second, third and fourth buckets 182, 184, 186 and 188. With support arm 170 attached to cylinder rod 166, the mixing blade 176 may be moved from one container to the other for mixing the contents of each container, in turn. Mixing blade 176 is moved from one container to another container by extending the hydraulic cylinder rod 166 and pivoting the rod within the hydraulic cylinder 165 to mix each batch in each of the containers. The rotating mixing blade 176 may be used in combination with the rotating bucket and bucket holder combinations for more thoroughly and more rapidly mixing the contents of each of the buckets in accordance with another aspect of the present invention.

There has thus been shown a variable speed mixer particularly adapted for mixing solutions such as inks and paints which includes a plurality of containers, or buckets, each positioned on a rotating disc-shaped holder. Each of the bucket holders is rotationally displaced by means of a hydraulic motor, where the speed of rotation may be fixed over a wide range of RPMs or may be varied over the range of RPMs in a continuous manner. The contents of all of the buckets may be mixed simultaneously, or the contents of a single bucket may be mixed. Provision is made for lifting and removing each of the buckets, which may typically contain 15 gallons and weigh on the order of 120 pounds, from a support platform of the mixer apparatus. An adapter kit allows smaller portions, i.e., on the order of three (3) gallons, to be mixed without modifying the mixer apparatus. In another embodiment, a single pivoting mixing element is mounted to the mixing apparatus support platform and is moveable between the various containers for mixing the contents thereof. The contents of each of the buckets may be mixed by both rotating the bucket as well as by the aforementioned pivoting mixing element at the same time.

While particular embodiments of the present invention have been shown and described, it will be obvious to those skilled in the art that changes and modifications may be made without departing from the invention in its broader aspects. For example, while the present invention has been disclosed in terms of mixing four containers of four solutions, this invention contemplates the mixing of the solutions of virtually any number of containers either simultaneously or individually. In addition, the solutions in each of the containers may be mixed at a fixed or a variable speed. Therefore, the aim in the appended claims is to cover all such changes and modifications as fall within the true spirit and scope of the invention. The mater set forth in the foregoing description and accompanying drawings is offered by way of illustration only and not as a limitation. The actual scope of the invention is intended to be defined in the following claims when viewed in their proper perspective based on the prior art.

I claim:

1. Apparatus for mixing ink or paint, said apparatus comprising:

a support surface;

a plurality of bucket holders disposed on said support surface, wherein each holder is adapted to receive and support a respective bucket containing a batch of ink or paint;

a mixing blade disposed in the batch of ink or paint in each of said buckets;

hydraulic drive means for rotationally displacing each of said holders and a respective bucket disposed thereon at a selected RPM; and first control means coupled to said hydraulic drive means and responsive to a user input for varying the RPM at which each bucket and holder combination is driven over a range of RPMs in a continuous manner.

2. The apparatus of claim 1 wherein said hydraulic drive means includes a hydraulic motor coupled to each of said bucket holders.

3. The apparatus of claim 2 wherein said first control means includes an electric motor and a manual, continuously variable valve coupled to each of said hydraulic motors for selecting the RPM at which each bucket and holder combination rotates over a continuous range of RPMs.

4. The apparatus of claim 3 further comprising a plurality of support posts for pivotally mounting each of said mixing blades to said support surface in a moveable manner.

5. The apparatus of claim 1 wherein said mixing blade is pivotably coupled to said support surface and is moveable between said buckets for mixing a respective batch in each of said buckets.

6. The apparatus of claim 5 further comprising a hydraulic cylinder coupling said mixing blade to said support surface.

7. The apparatus of claim 6 further comprising a hydraulic motor coupled to said mixing blade for rotationally displacing said blade at a selected RPM.

8. The apparatus of claim 7 further comprising second control means coupled to said hydraulic motor for selecting the RPM at which said mixing blade rotates over a continuous range of RPMs.

9. The apparatus of claim 8 wherein said mixing blade comprises a generally flat, disc-shaped sawtooth blade.

10. The apparatus of claim 1 further comprising hoist means for engaging and removing each of said buckets from said support surface.

11. The apparatus of claim 10 wherein said hoist means includes a support frame and a hoist mechanism movably disposed on said support surface.

12. The apparatus of claim 11 further comprising wheels on said support frame and tracks on said support surface, wherein said tracks are adapted for receiving said wheels and facilitating displacement of said support frame on said support surface.

13. The apparatus of claim 12 wherein said hoist means further includes a bar inserted through facing apertures in each of said buckets.

14. The apparatus of claim 1 wherein said hydraulic drive means includes a plurality of hydraulic motors each coupled to a respective bucket holder and an electric motor and hydraulic reservoir combination coupled to each of said hydraulic motors.

15. The apparatus of claim 1 wherein in each bucket holder includes a lock number and each bucket includes an outer flange for engaging a lock member when said bucket holder is rotationally displaced for preventing slippage of the bucket on the bucket holder.

16. The apparatus of claim 1 further comprising an adapter positioned on a bucket holder for receiving a bucket of smaller size for mixing smaller batches of ink or paint.

* * * * *